US011758962B2

(12) United States Patent
Havola

(10) Patent No.: US 11,758,962 B2
(45) Date of Patent: Sep. 19, 2023

(54) ADAPTABLE MOUNTING SYSTEM FOR MOUNTING ONE OR MORE ACCESSORY DEVICES TO A HELMET

(71) Applicant: Savox Communications Oy Ab (Ltd), Espoo (FI)

(72) Inventor: Jaakko Havola, Espoo (FI)

(73) Assignee: SAVOX COMMUNICATIONS OY AB (LTD), Espoo (FI)

( * ) Notice: Subject to any disclaimer, the term of this patent is extended or adjusted under 35 U.S.C. 154(b) by 235 days.

(21) Appl. No.: 16/486,715

(22) PCT Filed: Feb. 15, 2018

(86) PCT No.: PCT/FI2018/050113
§ 371 (c)(1),
(2) Date: Aug. 16, 2019

(87) PCT Pub. No.: WO2018/150097
PCT Pub. Date: Aug. 23, 2018

(65) Prior Publication Data

US 2020/0008508 A1 Jan. 9, 2020

(30) Foreign Application Priority Data

Feb. 17, 2017 (EP) ..... 17156580

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/30; A42B 3/04; A42B 3/303; A42B 3/306; B62J 11/24
USPC ..... 2/422
See application file for complete search history.

(56) References Cited

U.S. PATENT DOCUMENTS 5,467,479 A * 11/1995 Mattes ..... A42B 3/04 2/6.3
7,963,426 B2 * 6/2011 Gruebel ..... H01R 13/73 224/181
8,337,036 B2 * 12/2012 Soto ..... H01M 50/213 362/105
8,529,082 B1 * 9/2013 Baker ..... F21V 33/0076 362/105

(Continued)

FOREIGN PATENT DOCUMENTS

WO WO 2016049115 3/2016

OTHER PUBLICATIONS

International Search Report, PCTFI2018/050113, dated Apr. 30, 2018.
European Search Report, EP 17 15 6580, dated Jul. 25, 2017.

*Primary Examiner* — Alissa L Hoey
(74) *Attorney, Agent, or Firm* — NIXON & VANDERHYE

(57) ABSTRACT

Disclosed is a mounting system for mounting one or more accessory devices to a helmet. The system including a pair of mounting rails for attachment on respective sides on exterior of the helmet shell; and a clamping arrangement for attachment on exterior of the helmet shell between the pair of mounting rails substantially in the back portion of the helmet shell, wherein the clamping arrangement is coupled to at least one of the mounting rails via a coupling having an adjustable length for enabling attachment to helmet shells having various properties.

14 Claims, 7 Drawing Sheets

(56) References Cited

U.S. PATENT DOCUMENTS 10,289,160 B2 * 5/2019 Chan ..... G06F 1/163
10,959,473 B2 * 3/2021 Chen ..... A42B 3/0406
11,266,199 B2 * 3/2022 Wong ..... A42B 3/0406
2006/0072007 A1 * 4/2006 Gilor ..... H04N 5/77 348/61
2006/0162036 A1 * 7/2006 McCalla ..... A42B 3/04 2/6.2
2010/0012692 A1 * 1/2010 Harris ..... A42B 3/04 224/181
2010/0064405 A1 3/2010 McGovern
2010/0083413 A1 4/2010 McGovern
2011/0113519 A1 5/2011 Gendron et al.
2011/0239354 A1 10/2011 Celona et al.
2011/0314594 A1 12/2011 Rogers et al.
2013/0086722 A1 * 4/2013 Teetzel ..... H02J 1/00 2/2.5
2013/0191967 A1 8/2013 Harris
2014/0000013 A1 1/2014 Redpath et al.
2014/0020159 A1 * 1/2014 Teetzel ..... A42B 3/04 2/422
2014/0084120 A1 * 3/2014 Solinsky ..... A42B 3/04 248/227.1
2014/0189938 A1 * 7/2014 Redpath ..... A42B 3/0406 2/422
2015/0089726 A1 * 4/2015 Long ..... A42B 3/0406 2/422
2015/0223540 A1 * 8/2015 Daniels ..... A42B 3/14 224/272
2016/0058091 A1 * 3/2016 Sasaki ..... H04N 5/2251 348/376
2016/0088891 A1 * 3/2016 Walsh ..... A42B 3/04 2/421
2018/0092419 A1 * 4/2018 Banducci ..... A42B 3/28
2018/0180894 A1 * 6/2018 Pombo ..... G02B 27/0172
2018/0192726 A1 * 7/2018 Chen ..... A42B 3/04
2018/0231404 A1 * 8/2018 Kitain ..... H01R 13/6598
2019/0101359 A1 * 4/2019 Zimmer ..... A42B 3/30
2020/0113265 A1 * 4/2020 Gehring ..... F41H 1/04
2022/0071336 A1 * 3/2022 Franzino ..... A42B 3/04

* cited by examiner

ADAPTABLE MOUNTING SYSTEM FOR MOUNTING ONE OR MORE ACCESSORY DEVICES TO A HELMET

TECHNICAL FIELD

The invention concerns in general the technical field of mounting systems for a helmet. Especially the invention concerns a mounting system that is suitable to almost any helmet.

BACKGROUND

Helmets are used as a standard piece of equipment in many tactical applications to provide protection for the head of a user of the helmet. Helmets equipped with a protective shell providing ballistic protection against bullets and/or shrapnel are typically used in combat conditions, while helmets equipped with a protective shell providing impact protection may be used in conditions, where the ballistic protection is not needed, such as in training conditions. Some examples of tactical applications where helmets may be used are military, police, firefighters, border control, special forces under interior ministry, special forces under foreign ministry, construction workers, miners, etc.

Lately, helmets that may be equipped with further components or devices have emerged and found use in tactical applications. Such additional components or devices may include, for example, imaging devices and/or communication devices.

However, the current solutions for attaching further components or devices to a helmet are typically tailor-made solutions designed for a certain helmet, thereby calling for duplication and re-design of the arrangements required for attaching further components or devices for each helmet type separately, consequently leading to rather costly development and manufacturing of such helmet systems.

Alternatively, some prior art solutions for attaching further components or devices to a helmet are not suitable for mounting heavy accessories and/or for accessories that require substantially stable mounting to the helmet because of a flexible, i.e. elastic, mounting system. Additionally, one drawback of some prior art solutions is that they are not suitable for mounting accessory devices requiring data and/or power interface, because the prior art solutions do not provide power and/or data capability.

SUMMARY

An objective of the invention is to present a mounting system for mounting one or more accessory devices to a helmet. Another objective of the invention is that the mounting system for mounting one or more accessory devices to a helmet is suitable for almost any helmet regardless of the properties of the helmet.

The objectives of the invention are reached by a mounting system as defined by the respective independent claims.

According to a first aspect, a mounting system for mounting one or more accessory devices to a helmet is provided, the system comprising: a pair of mounting rails for attachment on respective sides on exterior of the helmet shell; and a clamping arrangement for attachment on exterior of the helmet shell between the pair of mounting rails substantially in the back portion of the helmet shell, wherein the clamping arrangement is coupled to at least one of the mounting rails via a coupling means having an adjustable length for enabling attachment to helmet shells having various properties.

Furthermore, at least one of the mounting rails may comprise one or more accessory rails and/or one or more mounting spots for detachably mounting an accessory device there to.

Additionally, the clamping arrangement may have a concave surface for facing a convex surface on exterior of the helmet shell for secure attachment thereto.

The clamping arrangement may further comprise fixing means for attaching the clamping arrangement to a respective fixing point of the helmet shell for improved mechanical strength and stability of the attachment.

Furthermore, each of the mounting rails may comprise a fixing means for anchoring said mounting rail to a respective fixing point of the helmet shell for improved mechanical strength and stability of the attachment.

The fixing means may be an existing mounting hardware of the helmet and the respective fixing point of the helmet shell may be an existing mounting point of the helmet.

The clamping arrangement may further comprise a fixing arrangement for anchoring the clamping arrangement to a trim of the helmet shell.

Furthermore, the fixing arrangement of the clamping arrangement may be a hook-shaped component configured to extend around the trim of the helmet shell.

The clamping arrangement may further comprise a control interface configured to at least provide an electrical connection to one or more external units.

At least one of the mounting rails may further comprise one or more accessory connection ports configured to provide an electrical connection to the one or more accessory devices attached there to.

Furthermore, the coupling means may be configured to provide electrical connection between the clamping arrangement and the at least one of the mounting rails.

The clamping arrangement may further comprise one or more accessory connection ports configured to provide an electrical connection to the one or more accessory devices attached there to.

The mounting system may further comprise adjusting means for adjusting the length of the coupling means, wherein the adjusting means may be at least one of the following: adjustment knob, adjustment wheel, wheeling mechanism, one or more hook-and-loop fastener.

The mounting system may further comprises one or more additional mounting rails arranged on exterior of the helmet, wherein the one or more additional mounting rails may be coupled to at least one of the mounting rails via a coupling means having an adjustable length for enabling attachment to helmet shells having various properties.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
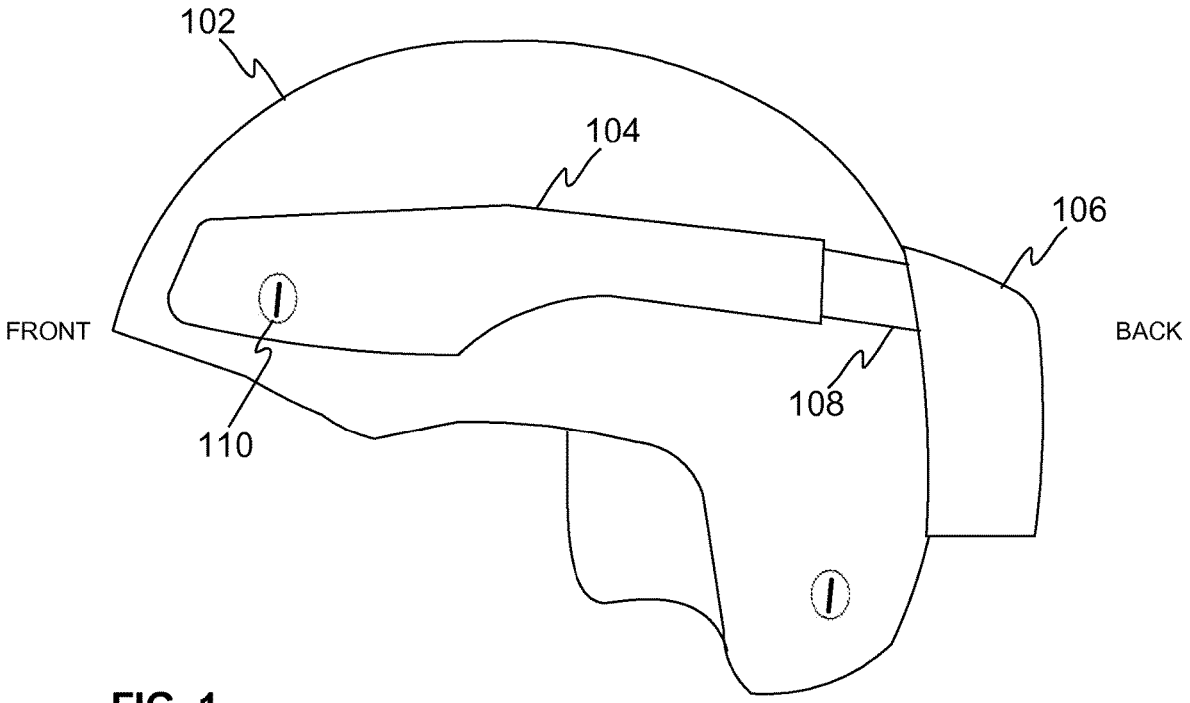
FIG. 1 illustrates schematically an example of the mounting system according to the invention attached to a helmet.

FIG. 1 schematically illustrates an example of a mounting system according to the invention, when attached to a helmet 102. The mounting system enables mounting of one or more accessory devices to a helmet 102. The mounting system comprises a pair of mounting rails 104 and a clamping arrangement 106. The mounting system according to the invention is suitable for almost any helmet regardless of the properties of the helmet, such as size, shape, type, shell thickness, brand, for example. Some non-limiting examples of different type of helmets are at least the following: protective helmet, tactical helmet, combat helmet. Furthermore, some examples of tactical applications where helmets may be used are at least the following: military, police, firefighters, border control, special forces under interior ministry, special forces under foreign ministry, construction workers, miners. For sake of clarity, a harness system, i.e. retention system, for securing the helmet to the head of a user and/or a suspensions system for absorbing the impact energy are not illustrated in FIG. 1.

The clamping arrangement 106 is coupled to at least one of the mounting rails 104 via a coupling means 108 having an adjustable length. The coupling means (coupling part) 108 may provide mechanical coupling and/or electrical coupling between the at least one of the mounting rails 104 and the clamping arrangement 106. In order to provide both mechanical and electrical coupling the coupling means (coupling part) 108 may be implemented as separate mechanical part of the coupling means for proving mechanical coupling, for example a lace or a strap, together with a separate electrical part of the coupling means for providing electrical coupling, for example electrical wirings. The mechanical part of the coupling means and the electrical part of the coupling means may be arranged to travel parallel or one on the other. Alternatively, the coupling means 108 may be implemented as a common coupling means for providing mechanical and electrical coupling, for example electrical wirings integrated to a wire, lace or strap. The adjustable length of the coupling means 108 enables attachment of the mounting system to helmet shells 102 of various properties, such as size, shape, type, shell thickness, brand, for example. In other words the adjustable length of the coupling means 108 enables a longitudinal adjustment of the mounting system. Furthermore, the coupling means 108 is able to adapt to the shape of the helmet shell. This enables that the mounting rails 104 and/or the clamping arrangement 106 may be arranged to be as close to the helmet shell as possible so that gaps between the mounting rails 104 and the helmet shell and/or between the clamping arrangement 106 and the helmet shell are at least partly eliminated. The mounting system may comprise adjusting means for adjusting the length of the coupling means, as will described in more detail later in this application. Some examples of the coupling means 108 may comprise at least one of the following: wire, set of connected links, chain, lace, strap. The coupling means 108 may be either elastic or rigid in the axial direction of pull, such as steel wire, or fiber wire made of any suitable fiber, such as aramid, combined with adjusting means for adjusting the length of the coupling means 108. In FIG. 1 is schematically illustrated one example of the coupling means 108 according to the invention, wherein the coupling means 108 are implemented as length adjustable strap.

The mounting system according to the invention may enable detachably mounting one or more accessory devices, such as one or more of an illuminator; a night vision device; a hearing protection; an imaging device, such as a camera; an oxygen mask; a speaker arrangement; a microphone arrangement; a compass arrangement; an identification beacon; an accelerometer arrangement; a sensor arrangement of other type; etc. equipped with means for attaching the accessory device to the type of the mounting system. The accessory device may also constitute an electronic device to be connected to the mounting system via an accessory connection port enabling an electrical connection in addition to a mechanical connection as will be described in more detail later in this application.

Figure 2:
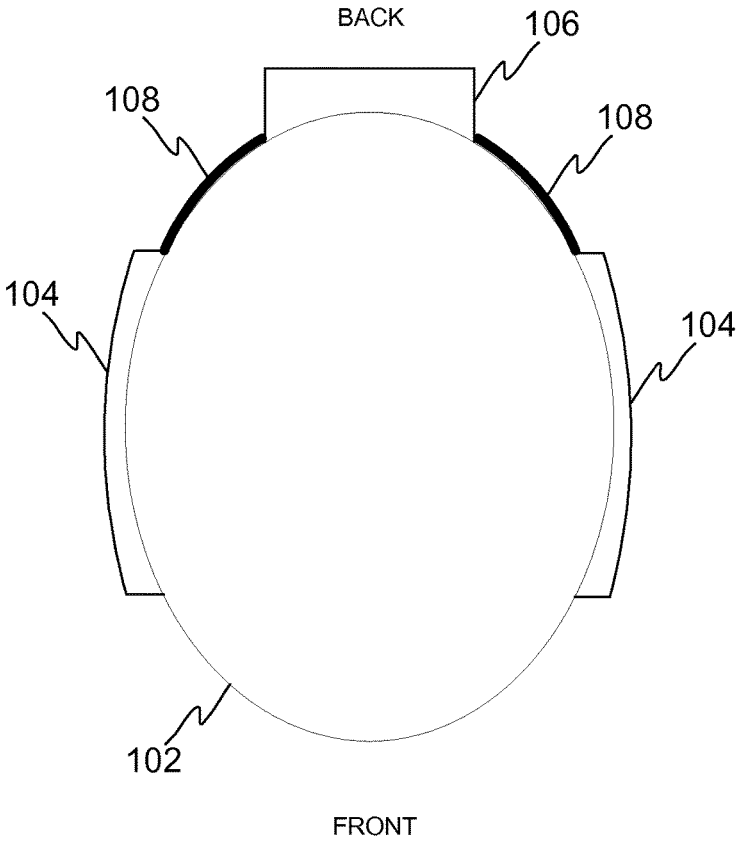
FIG. 2 illustrates schematically an example of the mounting system according to the invention attached to a helmet from another view.

The pair of mounting rails 104 may be arranged on respective sides on exterior of the helmet shell 102 as indicated in FIG. 2 schematically illustrating the mounting system attached to a helmet viewed from the above, i.e. providing a view towards the top portion of the exterior of the helmet 102. FIG. 1 illustrates only one non-limiting example of the shape of the mounting rails 104. The shape of the mounting rails may vary depending on the intended use of the mounting system, for example. Preferably, the shape of a mounting rail may be such that it enables a stable mounting of multiple accessory devices.

Each of the mounting rails 104 may comprise a fixing means 110 for anchoring said mounting rail to a respective fixing point in the helmet shell 102 in order to improve mechanical strength and stability of the attachment. The fixing means 110 may be mounting hardware, such as one or more screw, bolt or similar, for example. The respective fixing point in the helmet shell may be an existing mounting point of the helmet 102, such as mounting hole, mounting point, or mounting insert. Some examples of mounting points of the helmet may be at least one the following: a through hole in the helmet shell; insert or similar embedded into a structure of the helmet shell, for example in case of laminated helmet shell, multilayer helmet shell, or ceramic helmet shell; mounting point integrated to the helmet shell, for example in case of injection molded or otherwise molded helmet shells; mounting point jointed with adhesive or similar to the helmet shell.

Typically in many helmets these one or more mounting points together with mounting hardware, such as one or more screw, bolt or similar, are readily available and used for jointing the helmet shell and the harness system, i.e. retention system, and/or suspension system, for example. Thus the mounting rails 104 may be attached to the helmet shell without need for drilling any additional holes to the helmet shell. Furthermore, by using the already existing mounting points together with already existing mounting hardware, for attachment of the mounting rails 104 to the helmet shell, a ballistic re-testing may be minimized, because the structure of the helmet shell 102 is not modified by drilling. Furthermore, drilling a hole through a ballistic helmet shell may be very challenging. Thus, the use of already existing mounting points together with the already existing mounting hardware enables that the mounting system is easy to retrofit to an already existing helmet. Moreover, the mounting hardware, such as one or more screw, bolt or similar, are part of the ballistically protective system. Therefore, by replacing original, i.e. already existing, mounting hardware of the helmet with some other mounting hardware, the protection level of the helmet may be decreased and/or ballistic re-testing may be required. Thus, the use of the existing mounting hardware together with the existing mounting points is advantageous. FIG. 1 illustrates one example of the fixing means 110 of the mounting rails 104, wherein one already existing mounting point of the helmet 102 with existing mounting hardware such as a screw is used as fixing means 110 of the mounting rails 104. While FIG. 1 illustrates mounting hardware comprising one screw with one mounting point, a mounting rail 104 may comprise any number of mounting hardware and mounting points considered suitable for the intended use of the mounting system.

Alternatively or in addition, the fixing means 110 of the mounting rails 104 may comprise at least one of the following: one or more permanent magnet; one or more hook-and-loop fastener, i.e. touch fastener, such as Velcro tape. If the fixing means 110 of the mounting rails 104 is implemented as one or more permanent magnet, the respective fixing point in the helmet may be any receiving area comprising material that is attracted to the magnet. Alternatively, if the fixing means 110 of the mounting rails 104 is implemented as one of the following: hook fastener, loop fastener, the respective fixing point in the helmet may comprise the other one of the following: hook fastener, loop fastener.

Anchoring each of the mounting rails 104 to the helmet shell 102 by means of the fixing means 110 enables a stable, i.e. solid, attachment to the helmet shell. The stable, i.e. solid, attachment of the pair of mounting rails 104 is essential especially at least for the following accessory devices (in the parenthesis is described at least one reason why stable attachment is needed for the accessory device in question):

- a night vision device (to provide stable and clear picture without fatigue to the eyes of the user),
- a camera (to provide stable and clear image, such as video image or still image),
- an oxygen mask (to prevent at least partly leakages between the mask and user's face),
- a hearing protection (to maintain ascertain pressure),
- a display device (to provide stable mount for reading the display), and
- a position and 3D orientation sensor device and a helmet mounted display for Augmented Reality (AR) purposes (to provide stable mount without slack or play).

Additionally or alternatively, some other heavy accessories may require a stable, i.e. solid, mounting system in order to improve the balance of the helmet 102. Moreover, the pair of mounting rails 104 may be arranged close to the trim of the helmet shell 102 in order to enable mounting the one or more accessory devices so that the center of the gravity of the helmet in combination with the mounting system attached to it is as low as possible. This improves stability of the mounting system and reduces at least partly fatigue of a user.

Figure 3:
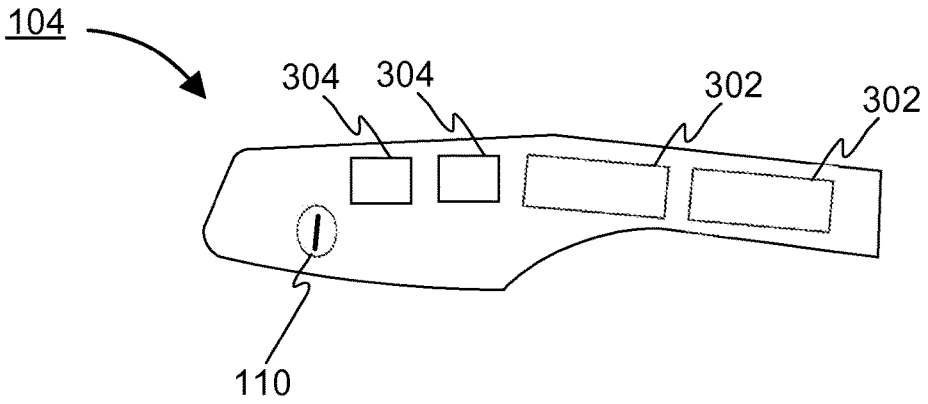
FIG. 3 illustrates schematically an example of a mounting rail of the mounting system according to the invention.

Each of the mounting rails 104 may further comprise one or more accessory rails 302 and/or one or more mounting spots, i.e. mounting places, 304 of another type for detachably mounting an accessory device there to. The one or more mounting spots 304 of another type may enable attaching an accessory device, for example by press fit, by a latch arrangement, by a screw arrangement, etc. The one or more accessory rails may be STANAG 2324 rails, MIL-STD-1913 rails (a.k.a. Picatinny rails), STANAG 4694 rails (a.k.a. NATO accessory rails), NATO Powered Rail or similar rail with power and data capability, KeyMod rails, M-LOK rails, HKey rails, and/or corresponding arrangements for detachably mounting accessory devices equipped with mounting means according to the respective standard. FIG. 3 schematically illustrates an example of a mounting rail 104 comprising two accessory rails 302 and two mounting spots 304 of another type. While FIG. 3 illustrates two accessory rails 302, a mounting rail 104 may comprise any number of accessory rails 302 considered suitable for the intended use of the mounting system. Similarly, while FIG. 3 illustrates two mounting spots 304 of another type, a mounting rail 104 may comprise any number of mounting spot 304 of another type considered suitable for the intended use of the mounting system.

The clamping arrangement 106 may be arranged on the exterior of the helmet shell 102 between the mounting rails 104 substantially in the back portion of the helmet shell 102 as indicated in FIG. 2. The clamping arrangement 106 may have a concave surface facing a convex surface on exterior of the helmet shell 102 for secure, i.e. stable, attachment thereto as also illustrated in FIG. 2.

Alternatively or in addition, the clamping arrangement 106 may comprise fixing means for attaching the clamping arrangement 106 to a respective fixing point of the helmet shell 102 for improved mechanical strength and stability of the attachment of the clamping arrangement 106 to a helmet shell 102. The fixing means of the clamping arrangement 106 may be mounting hardware, such as one or more a screw, bolt or similar, for example. Moreover, the fixing means of the clamping arrangement 106 may be an existing mounting hardware, such as screw, bolt, or similar. The respective fixing point in the helmet shell 102 may be an existing mounting point of the helmet 102, such as mounting hole, mounting point, mounting insert, or similarly as described above for the fixing means 110 of the mounting rails 104. Thus, also the clamping arrangement 106 may be attached to the helmet shell 102 without the need for drilling any additional holes to the helmet shell 102 and similar advantages may achieved as described in the context of the fixing means 110 of the mounting rails.

Alternatively or in addition, the fixing means of the clamping arrangement 106 may be at least one of the following: one or more permanent magnet; one or more hook-and-loop fastener, i.e. touch fastener, such as Velcro tape. If the fixing means of the clamping arrangement 106 is implemented as one or more permanent magnet, the respective fixing point in the helmet may be any receiving area comprising material that is attracted to the magnet. Alternatively, if the fixing means of the clamping arrangement is implemented as one of the following: hook fastener, loop fastener, the respective fixing point in the helmet may comprise the other one of the following: hook fastener, loop fastener.

Figure 4A:
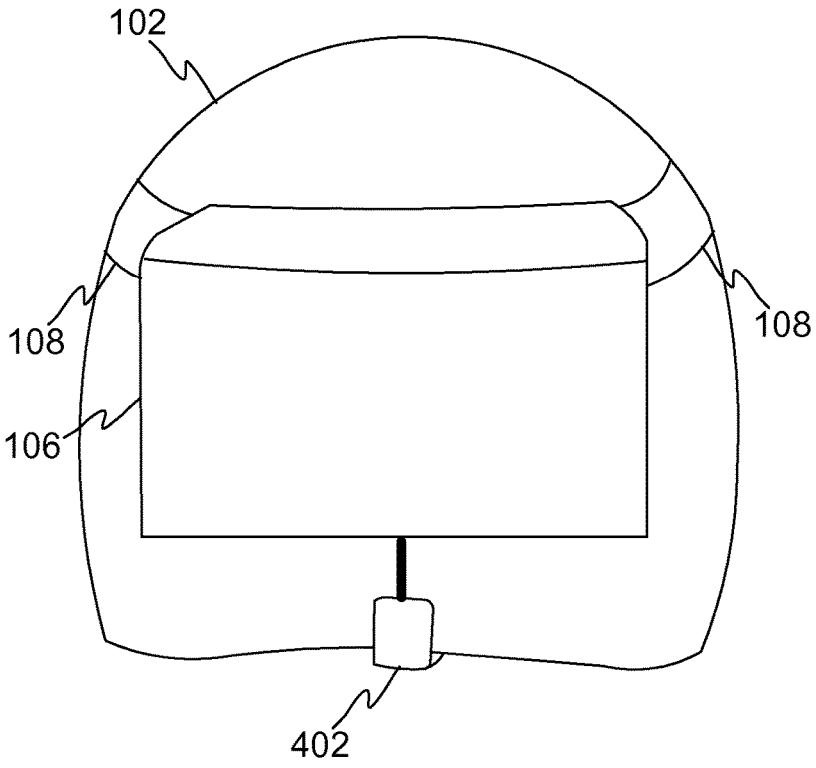
FIG. 4A illustrates schematically an example of a fixing arrangement of the clamping arrangement of the mounting system according to the invention.
Figure 4B:
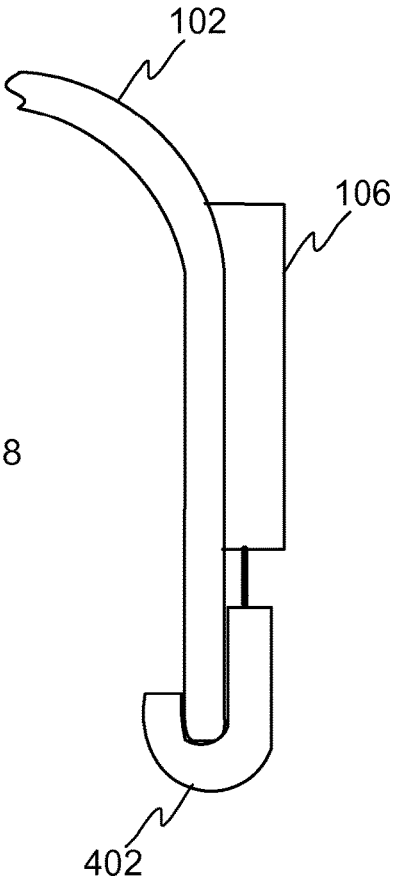
FIG. 4B illustrates schematically an example of a fixing arrangement of the clamping arrangement of the mounting system according to the invention from another view.

Alternatively or in addition, the clamping arrangement 106 may comprise a fixing arrangement 402 for anchoring the clamping arrangement 106 to a trim, i.e. edge, of the helmet shell 102 in order to at least partly improve the mechanical strength and stability of the attachment of the clamping arrangement 106 to a helmet shell 102. The fixing arrangement 402 of the clamping arrangement 106 may be for example a hook-shaped component that is configured to extend around, i.e. below, the trim of the helmet shell. FIG. 4A schematically illustrates an example of the fixing arrangement 402 of the clamping arrangement 106 viewed from behind the helmet 102. FIG. 4B schematically illustrates a side view of the example of the fixing arrangement 402 of the clamping arrangement 106 of FIG. 4A. Furthermore, the clamping arrangement 106 serves as a counter weight for the one or more accessory devices mounted, for example, to the front end of at least one of the mounting rails 104. This enables that any additional counter weight is not needed as in traditional mounting systems is needed.

The clamping arrangement 106 may further comprise a control interface configured to provide an electrical connection to one or more external units. The external unit may be for example a control unit, control device, computing unit, communication device etc. The external unit may be for example a communication device configured to provide a communication interface enabling communication to other corresponding communication devices. The external unit may be configured to receive and/or send data and/or commands of control signals via the control interface of the clamping arrangement 106. The control interface may comprise one or more external connection ports 502 for connecting one or more external units to the mounting system. Alternatively or in addition, each of the mounting rails 104 may further comprise one or more accessory connection ports 504, 504' for connecting an electronic accessory device to the mounting system. Alternatively or in addition, the clamping arrangement 106 may also comprise one or more accessory connection ports 504, 504' for connecting an electronic accessory device to the mounting system. The clamping arrangement 106 may comprise one or more electrical wirings configured to provide electrical connection between the control interface of the clamping arrangement 106 and one or more accessory connection port 504, 504' of the clamping arrangement 106. An accessory connection port 504, 504' may be a dedicated connection port for connecting an electronic accessory device of a predetermined type. Alternatively, an accessory connection port 504, 504' may be a generic connection port for connecting any electronic accessory device compliant with the communication protocol, e.g. data transfer protocol and/or a control protocol provided via the generic communication port. Each of the mounting rails 104 and/or the clamping arrangement 106 may comprise one or more dedicated communication ports and/or one or more generic communication ports. Attaching an accessory device to a mounting rail 104 comprising an accessory connection port 504, 504' enables at the same time mechanical and electrical connection of the accessory device to mounting rail 104. Alternatively, the accessory device may be mechanically mounted to one part of a mounting rail 104, for example to an accessory rail 302, and the electrical connection of said accessory device may be provided by an accessory connection port 504, 504' arranged to another part of the mounting rail 104, for example to another accessory rail 302, or to the clamping arrangement 106. The connection between the accessory device and the connection port 504, 504' may be provided with a cable, for example.

Figure 5:
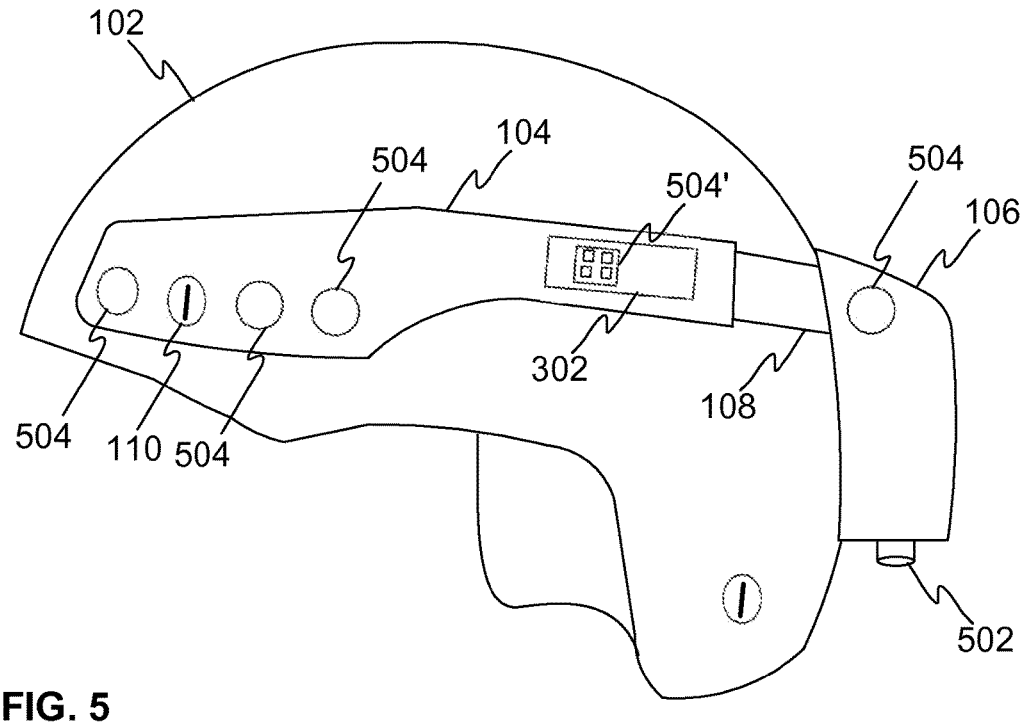
FIG. 5 illustrates schematically an example of one or more connection ports of the mounting system according to the invention.

As described hereinbefore, the coupling means 108 may provide mechanical coupling and/or electrical coupling between at least one of the mounting rails 104 and the clamping arrangement 106. The coupling means 108 may comprise one or more electrical wirings configured to provide electrical connection between control interface of the clamping arrangement 106 and one or more accessory connection port 504, 504' of at least one of the mounting rails 104. The electrical coupling may be provided by electrical wirings separate to the mechanical part of the coupling means, such as a wire, strap or similar. Alternatively, the electrical wirings may be integrated to the mechanical part of the coupling means 108 in order to form a common coupling means. FIG. 5 illustrates an example of one external connection port 502 of the control interface of the clamping arrangement 106, one example of accessory connection port 504 of the clamping arrangement 106, and one example of accessory connection ports 504, 504' of a mounting rail 104. FIG. 5 suggest four connection ports 504, 504' of the mounting rail 104. However a mounting rail 104 may comprise any number of accessory connection ports 504, 504' considered suitable for the intended use of the mounting system. Similarly, while FIG. 5 suggest one external connection port 502 of the control interface of the clamping arrangement 106, the control interface may comprise any number of external connection ports 502 considered suitable for the intended use of the mounting system. Furthermore, the clamping arrangement 106 may comprise any number of accessory mounting ports 504, 504' considered suitable for the intended use of the mounting system.

As described above, the coupling means 108 may comprise one or more electrical wirings. The coupling means 108 may comprise wiring configured to enable transfer of data either in one direction or in both directions between an accessory connection port 504, 504' of a mounting rail 104 and the control interface of the clamping arrangement 106. Such a wiring may be referred to as a data bus. Alternatively or in addition, the coupling means 108 may comprise wiring configured to enable transfer of commands or control signal either in one direction or in both directions between an accessory connection port 504, 504' of a mounting rail 104 and the control interface of the clamping device 106. Such a wiring may be referred to as a control bus. The data bus may be provided as a dedicated wiring, hence separate from the control bus, or the data bus may be a logical entity sharing the wiring with the control bus. Similarly, the control bus may be provided as a dedicated wiring, hence separate from the data bus, or the control bus may be a logical entity sharing the wiring with the data bus. The data bus or the control bus may comprise wiring that enables supplying power from or via the control interface of the clamping arrangement 106 to an accessory device connected to one or more of the one or more accessory connection ports 504, 504' of at least one of the mounting rails 104. Alternatively or in addition, the coupling means 108 may comprise dedicated wiring for providing power from or via the control interface of the clamping arrangement 106 to one or more of the one or more accessory connection ports 504, 504' of at least one of the mounting rails 104. The coupling means 108 may further comprise dedicated wiring for transferring audio signal between one or more of the one or more connection ports 504, 504' of at least one of the mounting rails 104 and the control interface of the clamping arrangement 106.

One or more of the one or more accessory connection ports 504, 504' of at least one of the mounting rails 104 and/or the clamping arrangement 106 may be dedicated connection ports for connecting a speaker arrangement. A dedicated connection port for connecting a speaker arrangement may be configured to provide an audio signal from the control interface of the clamping arrangement 106 to the accessory connection port 504, 504' of a mounting rail 104 or to the one accessory connection port 504, 504' of the clamping arrangement 106, and consequently to one or more speakers of the speaker arrangement. Some non-limiting examples of a speaker arrangement include a headphone or headphones comprising one or more speakers, an in-ear headphone, e.g. an earphone, an earmuff or a pair of earmuffs comprising one or more speakers, etc.

Alternatively or in addition, one or more of the one or more accessory connection ports 504, 504' of at least one of the mounting rails 104 and/or the clamping arrangement 106 may be dedicated connection ports for connecting a microphone arrangement. A dedicated connection port for connecting a microphone arrangement may be configured to provide an audio signal received via the accessory connection port 504, 504' of a mounting rail 104 or via the accessory connection port 504, 504' of the clamping arrangement 106 to the control interface of the clamping arrangement 106. Some non-limiting examples of a microphone arrangement include a boom microphone, a hear-through microphone arranged in a headphone or in an earmuff, an acoustic noise cancellation feedback microphone arranged in a headphone or in an earmuff, one or more microphones of a(n acoustic) sniper detection arrangement or a(n acoustic) gunfire locator arrangement, etc.

Additionally or alternatively, one or more of the one or more accessory connection ports 504 of at least one of the mounting rails 104 and/or the clamping arrangement 106 may be dedicated connection ports for connecting a combined speaker and microphone arrangement. A dedicated connection port of a mounting rail 104 or a clamping arrangement 106 for connecting a combined speaker and microphone arrangement may be configured to provide an audio signal from the control interface of the clamping arrangement 106 to the accessory connection port 504, 504' of a mounting rail 104 or to the accessory connection port 504, 504' of the clamping arrangement 106 and to provide an audio signal received via the accessory connection port 504, 504' of a mounting rail 104 or via the accessory connection port 504, 504' of the clamping arrangement 106 to the control interface of the clamping arrangement 106. Some non-limiting examples of a combined speaker and microphone arrangement include a hear-through microphone arranged in a headphone or in an earmuff, an acoustic noise cancellation feedback microphone arranged in a headphone or in an earmuff, etc.

The accessory connection port 504, 504' provides an electrical contact between the wiring of the coupling means 108 and an electronic accessory device connected to the accessory connection port 504, 504', thereby electrically coupling the electronic accessory device to the control interface of the clamping arrangement 106 via the wiring of the coupling means 108. An accessory connection port 504, 504' may provide an electric connection to the control bus, to the data bus, to the dedicated wiring for transferring audio signal, to the wiring for providing power or to any combination thereof.

An accessory connection port 504, 504' may comprise a socket, as schematically illustrated by the exemplifying accessory connection ports 504 in FIG. 5, for accepting a plug arranged in an electronic accessory device such that a plug inserted in the socket provides an electronic contact between the electronic accessory device and the wiring of the coupling means 108 or the wiring of the clamping arrangement 106. Alternatively, an accessory connection port 504, 504' may comprise one or more pins on the surface of the connection port, as schematically illustrated by the exemplifying accessory connection ports 504' in FIG. 5, for providing an electronic contact between an electronic accessory device equipped with mounting means provided with one or more pins in a corresponding arrangement on its surface and the wiring of the coupling means 108. Furthermore, an accessory connection port 504, 504' may comprise a fixed cable comprising a socket for accepting a plug arranged in an electronic accessory device such that a plug inserted in the socket provides an electronic contact between the electronic accessory device and the wiring of the coupling means 108 or wiring of the clamping arrangement 106.

Furthermore, the mounting system may comprise one or more accessory devices, such as a temperature sensor, blast sensor, microphone, speaker, etc., integrated to the mounting system. The integrated accessory device may be connected to an accessory connection port 504, 504', thereby electrically coupling the electronic accessory device to the control interface of the clamping arrangement 106 via the wiring of the coupling means 108. Alternatively, the integrated accessory device may be electrically connected directly to a wiring of the coupling means 108. Alternatively, the integrated accessory device may be electrically connected directly to a wiring arranged to the mounting rail 104 to which the accessory device is integrated, wherein the wiring of the mounting rail 104 is further connected to the wiring of the coupling means 108.

Figure 6:
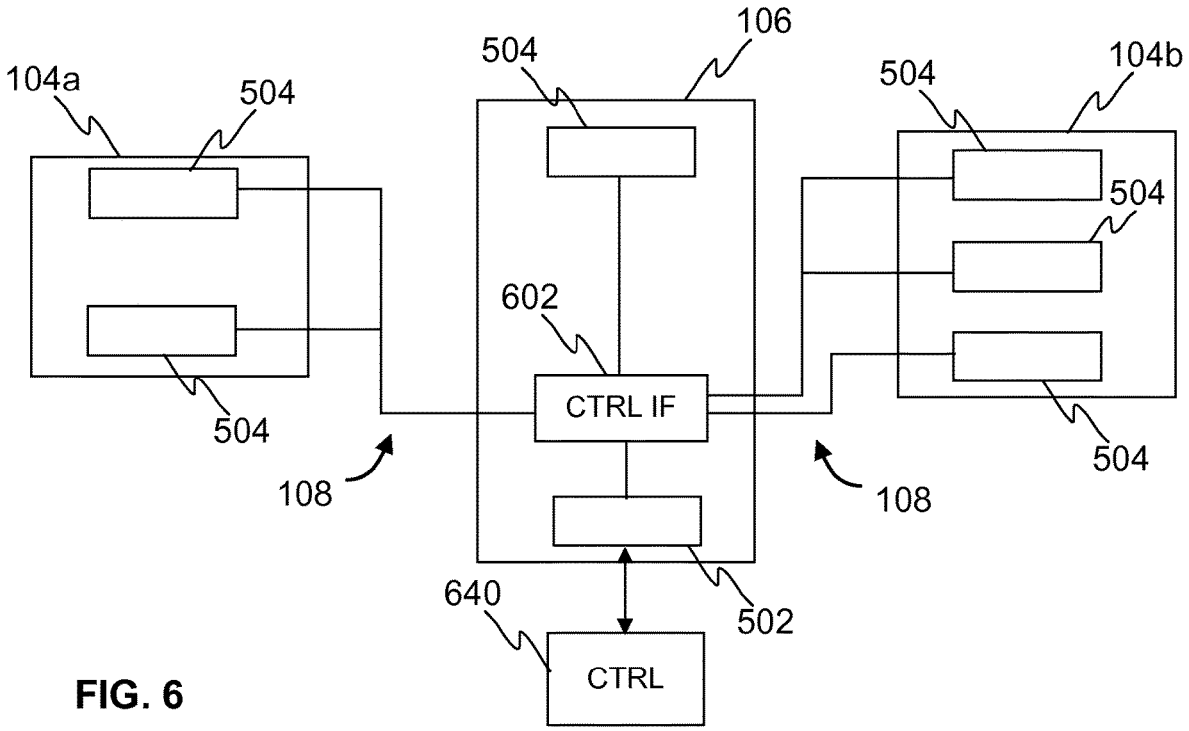
FIG. 6 illustrates schematically an example of electrical connections of the mounting system according to the invention.

FIG. 6 schematically illustrates an example of electrical connections of a mounting system. The first mounting rail 104*a* comprises two accessory connection ports 504 and the second mounting rail 104*b* comprises three accessory mounting ports 504. Furthermore, the clamping arrangement 106 comprises one accessory connection port 504 and one external connection port 502 for connecting an external control unit 640 to the mounting system. Alternatively, the control unit may be provided as a part of the clamping arrangement 106. The control unit 640 is described in more detail hereinafter. The number of accessory connection ports 504 and external connection ports 502 in the example illustrated in FIG. 6 is only one example and any number of connection ports considered suitable for the intended use of the mounting system may be provided. The accessory connection ports 504 of the mounting rails 104*a*, 104*b* are electrically connected to the control interface 602 of the clamping arrangement 106 by means of electrical wirings of the coupling means 108 e.g. via the control bus, via the data bus, via the dedicated wiring for transferring audio signal and/or via the dedicated wiring for proving operating power.

Figure 7:
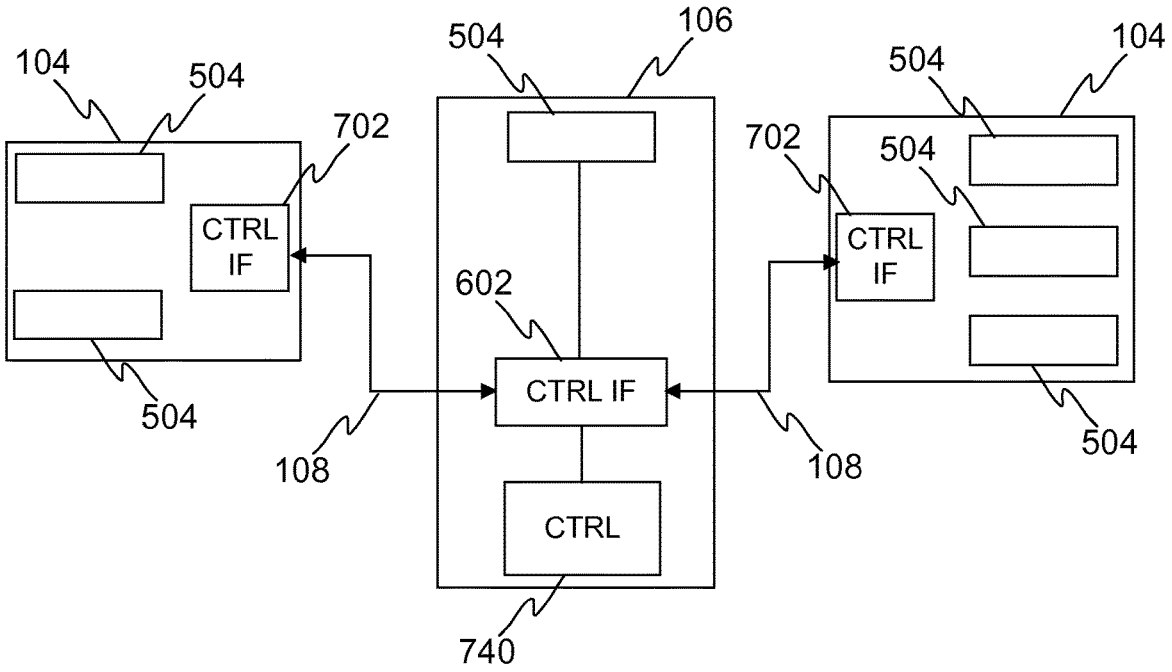
FIG. 7 illustrates schematically another example of electrical connections of the mounting system according to the invention.

Alternatively, each of the mounting rails 104 may comprise a control interface configured to provide an electrical connection between the mounting rail 104 and the clamping arrangement 106. The mounting rails 104*a*, 104*b* may comprise one or more electrical wirings configured to provide electrical connection between control interface of the mounting rail 104 and one or more connection port 504, 504' of the mounting rail 104. FIG. 7 schematically illustrates another example of electrical connections of a mounting system. The example mounting system of FIG. 7 is otherwise similar to the example mounting system of FIG. 6, but the mounting rails 104*a*, 104*b* comprise a control interface 702 for providing an electrical connection to the control interface 602 of the clamping arrangement 106 and the control unit 740 is provided as part of the clamping arrangement 106. Alternatively, the control unit may be provided as an external control unit connected to the control interface 602 of the clamping arrangement 106.

The electrical connections described hereinbefore enable that data, audio, power, and/or control signals may be transferred between an accessory device mounted or integrated to the mounting system and the control interface of the clamping arrangement and/or between an accessory device mounted to the mounting system and an external unit connected to the control interface of the clamping arrangement 106. Therefore, the mounting system according to the invention enables adding power and/or data capability to any helmet by means of the mounting system.

As described hereinbefore, the clamping arrangement 106 may comprise a control interface for connecting an external unit, such as an external control unit 640 as illustrated in FIG. 6. The control interface may comprise one or more further external connection ports 502 for connecting the wiring of the coupling means 108, e.g. the control bus, the data bus, dedicated wiring for transferring audio signal and/or dedicated wiring for providing operating power, to an external unit. Alternatively or in addition, the clamping arrangement 106 may comprise a shared data bus, for example an Universal Serial Bus (USB) hub, for connecting the one or more accessory connection ports 504, 504' coupled to the control interface of the clamping arrangement 106.

Alternatively, the clamping arrangement 106 may comprise a control unit 740 for controlling the operation of one or more electronic devices connected to the mounting system, the control unit 740 being connected to the control interface 602 as illustrated in FIG. 7. The control unit may further comprise a second interface, e.g. one or more further external connection ports, for connecting an external control unit to the mounting system.

The control unit 640, 740 may comprise one or more power management units for controlling the provision of the operating power via the wiring of the coupling means 108, e.g. via the control bus, via the data bus, via the dedicated wiring for transferring audio signal and/or via the dedicated wiring for proving operating power. The one or more power management units may receive power to be provided via the wiring of the coupling means 108 and/or wiring or the clamping arrangement 106 from the external control device via the one or more external connection ports 502. Alternatively or additionally, the control unit 640, 740 may comprise a power source, such as an arrangement for installing one or more batteries, e.g. a pair of AA batteries or one or more batteries of another type, for supplying power to the control unit 640, 740.

The control unit 640, 740 may further comprise a control function for controlling the accessory devices connected to the one or more accessory connection ports 504, 504' and a processing function for processing the data received from an accessory connection port 504, 504' or to be provided to a connection port 504, 504'. The control functionality and/or the processing function may be provided by one or more processing units, such as one or more digital signal processors (DSP) and/or one more general purpose processors. The one or more DSPs may be dedicated to specific function, e.g. to provide control and/or processing function for an electronic device of a predetermined type.

Moreover, the control unit 640, 740 may comprise one or more memory units for storing data received from a connection port 504, 504' or data to be provided to an accessory connection port 504, 504'. The one or more memory units may further serve to store control parameters, settings and computer program instructions that cause the control unit 640, 740, when executed by the one or more processing units, to control the information transfer via the wiring of the coupling means 108 and/or to process data received from an accessory connection port 504, 504' or data to be provided to an accessory connection port 504, 504'. In particular, control parameters, settings and computer program instructions may comprise driver software for controlling operation of and data exchange with an electronic device of a predetermined type connectable to the mounting system and electrically connectable to the processing unit via an accessory control port 504, 504' and the wiring of the coupling means 108 and/or wirings of the clamping arrangement 106.

The control unit 640, 740 may further comprise a data switching function for connecting one of the one or more accessory connection ports 504, 504' coupled to the control interface, and hence to the control unit via respective shared data bus to the external control device via the second interface. The data switching function may be provided e.g. by a data hub, for example an USB hub for connecting one of the accessory connection ports 504, 504' connected to the control interface via an USB bus.

Figure 8:
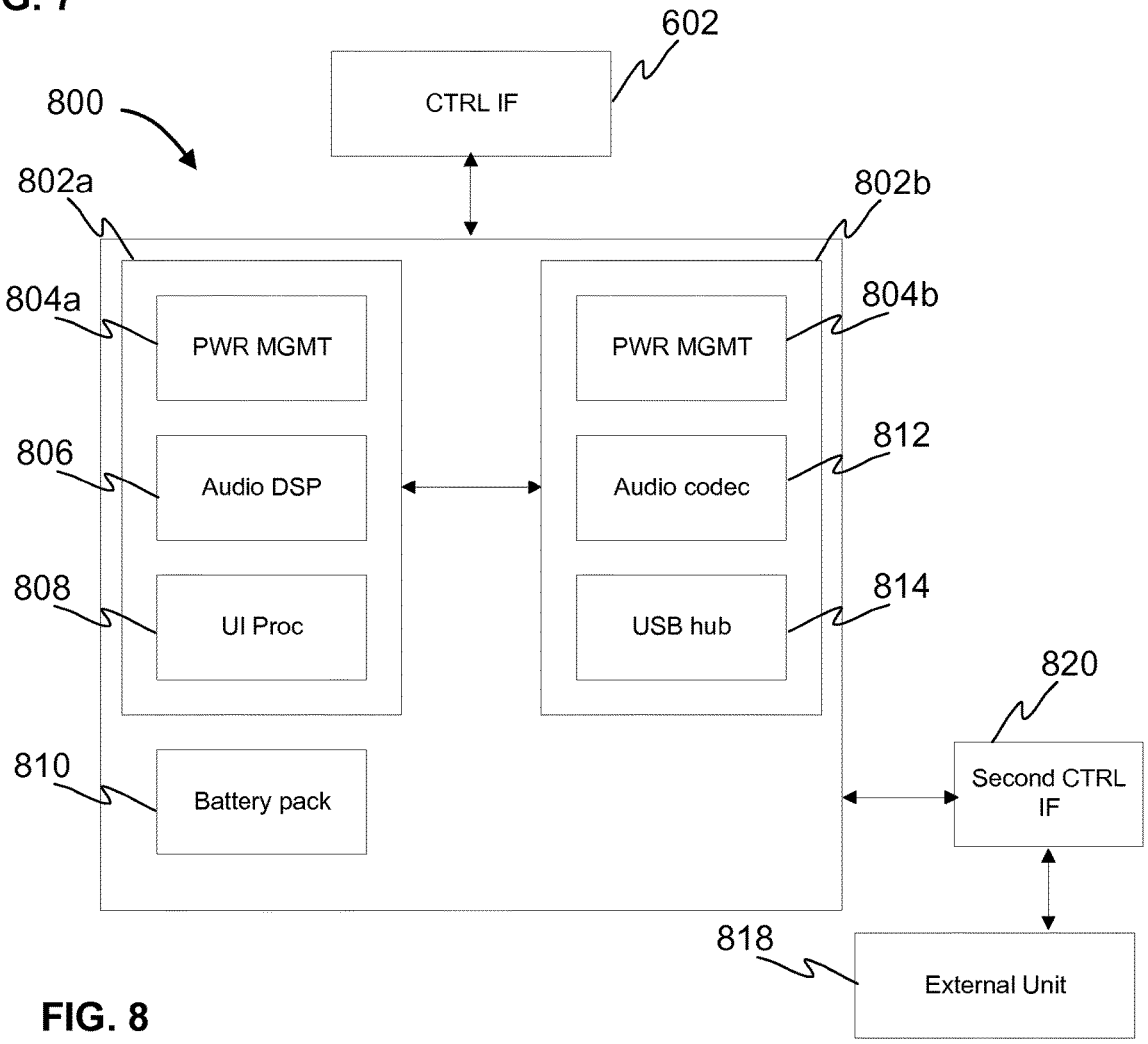
FIG. 8 illustrates schematically an example of a control unit according to the invention

FIG. 8 schematically illustrates an example of a control unit 800 coupled to the control interface 602 of the clamping arrangement 106. As described hereinbefore the control unit 740 may be provided as part of the clamping arrangement 106 as illustrated in FIG. 7 or the control unit 640 may be provided as an entity separate from the clamping arrangement 106 that may be connected to the clamping arrangement 106 via the control interface 602 of the clamping arrangement 106 as illustrated in FIG. 6. The exemplifying control unit 800 may act as the control unit 640, i.e. an external control unit connected to the control interface 602 of the clamping arrangement 106. Alternatively, the exemplifying control unit 800 may act as the control unit 740, i.e. a control unit provided as a part of the clamping arrangement 106.

The exemplifying control unit 800 comprises a first controller 802*a* and a second controller 802*b*. The first controller 802*a* comprises a first power management entity 804*a*, an audio DSP 806 and a user interface (UI) processor 808. The first controller 802*a* is further coupled to a battery pack 810. The second controller 802*b* comprises a second power management entity 804*b*, an audio codec 812 and a USB hub 814. The second controller 802*b* is further connected to an external power source e.g. via the second control interface 820, the external power source provided e.g. at the external control device 818. The control unit 800 may further comprise e.g. memory accessible by one or more of the processing units of the first controller 802*a* and/or one or more of the processing units of the second controller 802*b*.

In case the control unit 800 is not connected to an external control device 818 providing operating power to the control unit 800, only the first controller 802*a* is operational and the first power management entity 804*a* is configured to supply power via the wiring on basis of the power provided by one or more batteries that may be installed in the battery back 810. On the other hand, in case the external operating power is supplied, the first power management entity 804*a* is configured to supply power on basis of the external operating power.

The audio DSP 806 may be configured to provide active noise cancellation processing applied to an audio signal received from an active noise cancellation microphone connectable to an accessory connection port 504, 504' for provision to a speaker arrangement connectable to the same or another accessory connection port 504, 504'. Alternatively or additionally, as another example, the audio DSP 806 may be configured to provide audio signal enhancement processing applied to an audio signal received from a hear-through microphone connectable to a accessory connection port 504, 504' for provision to a speaker arrangement connectable to the same or another accessory connection port 504, 504'.

The UI processor 808 is configured to control the operation of the first controller 802*a*. The UI processor 808 may be provided e.g. as microcontroller or a general purpose processor. The UI processor 808 may comprise a memory or the UI processor 808 may be connected to a memory comprised in the control unit 800, e.g. in the first controller 802*a*. The UI processor 808 may be configured to, for example, control the first power management entity 804*a*, the audio DSP 806 and data transfer to and from the control unit 800 via the first controller 802*a* and (further) processing of data in the first controller 802*a*. The UI processor 808 may receive input or commands from a user interface of the clamping arrangement 106 connected thereto.

The second controller 802*b* is configured to be operational only in case external operating power is supplied from the external control device 818. The second power management entity 804*b* is configured to supply power via the wirings on basis of the external operating power supplied from the external control device 818. The external control device 818 may control the USB hub 814, for connecting one of the accessory connection ports 504, 504' connected to the control interface of the clamping arrangement 106 via an USB bus. Consequently, data transfer to and from as well as the operation of an electronic device connectable thereto may be controlled by the external control device 818 via the second controller 802*b*. In this example USB protocol is used, but also any other suitable protocols may be used in context of this invention.

The audio codec 812 may be configured to carry out digital-to-analog conversion of audio signal received from the external control device 818 over a USB connection for provision to a speaker arrangement connectable to an accessory connection port 504, 504'. The audio codec 812 may be, conversely, configured to carry out analog-to-digital conversion of audio signal received e.g. from a microphone arrangement connectable to an accessory connection port 504, 504'.

The functions of the exemplifying control unit 800 described hereinbefore serve merely as examples of the capabilities of the control unit 640, 740. The control unit 640, 740 may further comprise a number of further—physical or logical—processing and/or control units not described herein and/or the control unit 640, 740 may omit one or more of the functions described in context of the exemplifying control unit 800.

The mounting system may further comprise one or more user interfaces. The user interface may be arranged to at least one the following: clamping arrangement 106, mounting rails 104, accessory device, external control device. The user interface may comprise one or more buttons or keys for controlling the operation of an accessory device attached to the mounting system and connected to the control interface via an accessory connection port 504, 504'. Alternatively or in addition, the user interface may comprise one or more buttons or keys for controlling the operation of the whole mounting system or some of its functions. As an example, the user interface may comprise an 'on/off' button or switch for setting the electrical functions of the mounting system on or off.

As described earlier the mounting system may comprise adjusting means 902 for adjusting the length of the coupling means 108 in order to provide the length adjustment, which enables that the mounting system may be attached to helmet shells of various properties, such as size, shape, type, shell thickness, brand, for example. The adjusting means 902 may be arranged to at least one of the following parts of the mounting system: coupling means 108, the clamping arrangement 106, at least one of the mounting rails 104. The adjusting means 902 may be common for the electrical part of the coupling means and the mechanical part of the coupling means. Especially, if the coupling means 108 is implemented as a common coupling means for providing mechanical and electrical coupling, for example electrical wirings integrated to the strap or wire. Alternatively, the mounting system may comprise separate adjusting means 902 for adjusting the length of the mechanical part of the coupling means and for adjusting the length of the electrical part of the coupling means. The adjusting means 902 may be at least one of the following: adjustment knob, wheel or similar; wheeling mechanism; one or more hook-and-loop fastener, i.e. touch fastener, such as Velcro tape. The maximum physical length of the coupling means 108 defines the maximum size of the helmet to which the mounting system may be attached. Additionally, the mounting system may comprise a through or a channel for accommodating the excess length of the electrical part of the coupling means in order to at least partly preventing formation of loops of the excess length of the electrical part of the coupling means. The loops of the excess length of the electrical part of the coupling means may cause unwanted snagging to vegetation, for example. The adjustment knob or wheel may further comprise a locking means for locking the adjusted length of the coupling means 108.

Figure 9A:
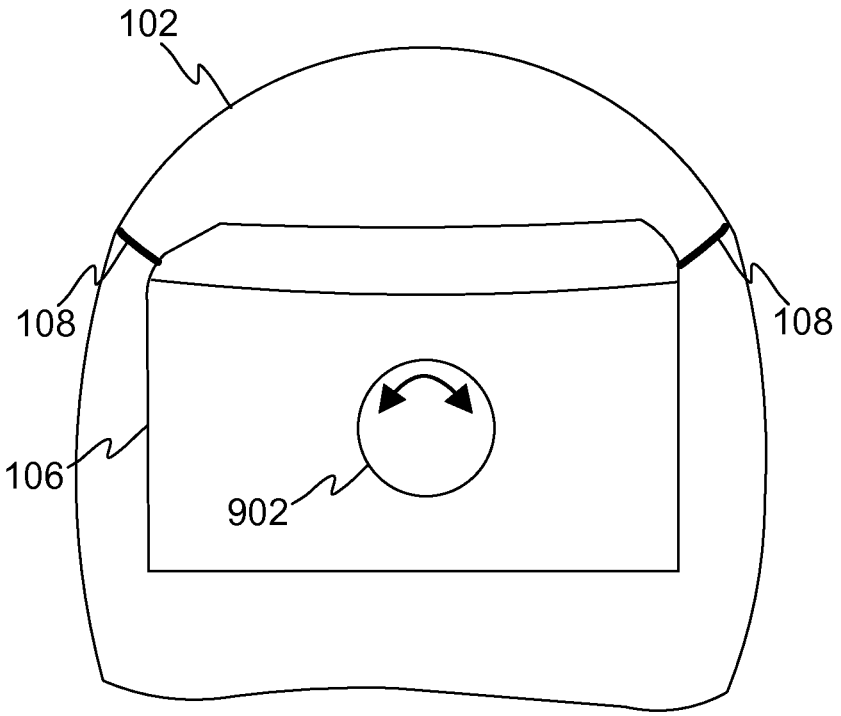
FIG. 9A illustrates schematically an example of adjusting means of the mounting system according to the invention.

One example of adjusting means according to the invention is illustrated in FIG. 9A, wherein the adjusting means 902 is implemented as an adjustment knob, wheel or similar. The adjustment knob 902 may be arranged to the clamping arrangement 106 as in the example illustrated in FIG. 9A. By turning the adjusting knob 902 in a first direction the length of the coupling means 108 is shorten and by turning the adjusting knob 902 in a second direction the length of the coupling means 108 is lengthen, wherein the first direction may be clockwise and the second direction may be counter clockwise or in vice versa.

In the above presented example the coupling means 108 are implemented as a common coupling means for providing mechanical and electrical coupling, for example electrical wirings integrated to the wire, together with a common adjusting means 902. Alternatively, the coupling means 108 may be implemented as separate mechanical part of coupling means for proving mechanical coupling, for example a wire, and separate electrical part of the coupling means for providing electrical coupling, for example electrical wirings, together with a common adjusting means 902, such as an adjustment knob or wheel for adjusting the length of the mechanical part of the coupling means and the electrical part of the coupling means. Alternatively, the mounting system may also comprise separate adjusting means 902 for mechanical part of the coupling means and for electrical part of the coupling means, for example separate adjusting knobs or wheels.

Figure 9B:
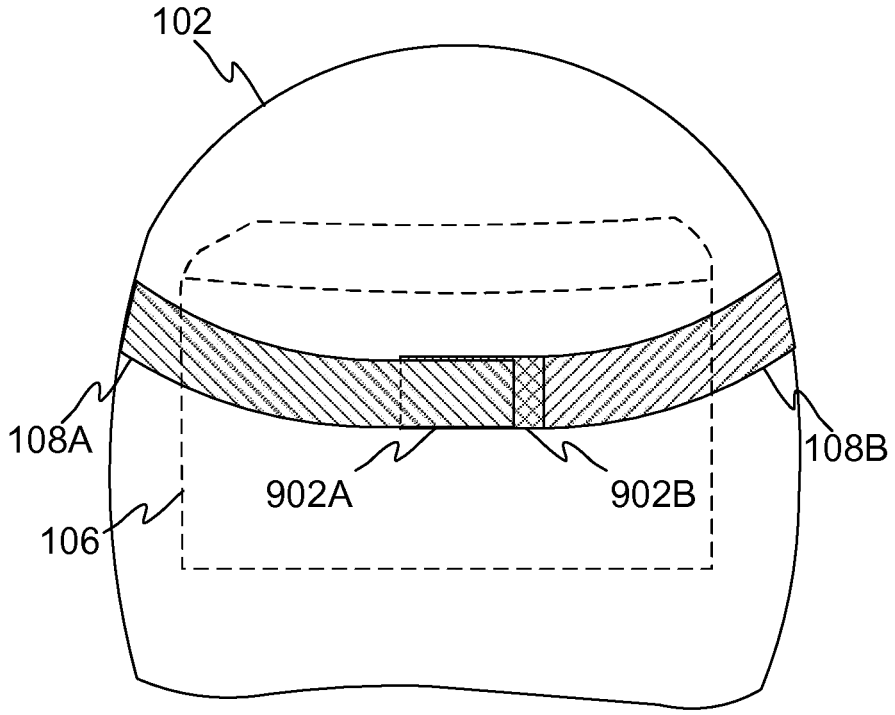
FIG. 9B illustrates schematically another example of adjusting means of the mounting system according to the invention.

One example of the adjusting means 902 according to the invention is illustrated in FIG. 9B, wherein the adjusting means 902 is implemented as a hook-and-loop fastener. One example how the hook-and-loop fastener, such as Velcro tape, may be arranged to the coupling means 108 that is implemented as a strap for example, is illustrated in FIG. 9B. A strap 108A, 108B may be arranged to one end of each of the mounting rails. For sake of clarity the mounting rails 104 are not shown in FIG. 9B. One of the hook fastener or loop fastener 902A may be arranged to one of the straps 108A substantially to the end of the strap 108A that is not the end which is attached to the mounting rail 104. The other one of the hook fastener or loop fastener 902B may be arranged to the other one of the straps 108B substantially to the end of the strap 108B that is not the end which is attached to the mounting rail 104. Moreover, one of the hook fastener or the loop fastener 902B may be arranged to the strap 108B facing outwards from the helmet shell 102 and the other one of the hook fastener 902A may be arranged to the other strap 108A facing towards the helmet shell 102 (the hook/loop fastener 902A is not shown in FIG. 9B, because it is facing towards the helmet shell 102). The straps 108A, 108B may be attached to each other inside the clamping means 106, for example, so that the one of the hook fastener or the loop fastener 902A and the other one of the hook fastener or the loop fastener 902B are facing towards each other and may be attached at least partly to each other in order to adjust the length of the coupling means 108, i.e. straps 108A, 108B so that the mounting system fits to the helmet shell 102 in question.

Figure 9C:
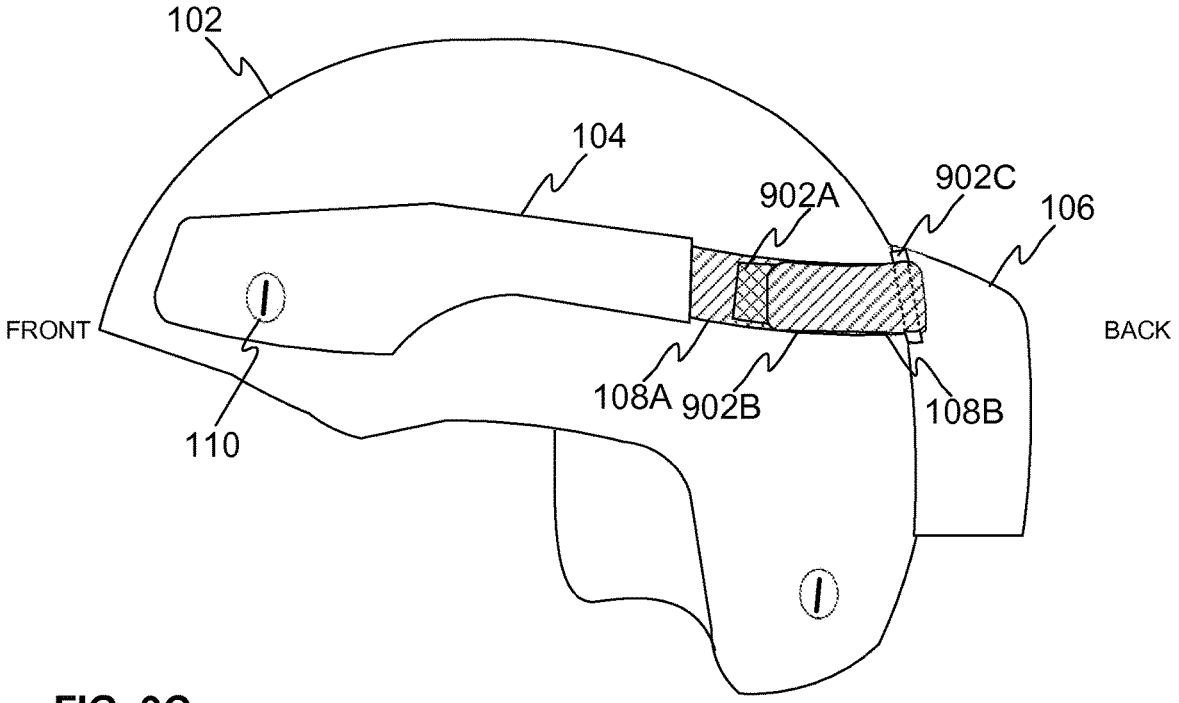
FIG. 9C illustrates schematically another example of adjusting means of the mounting system according to the invention.

Another example of the adjusting means 902 according to the invention, wherein the adjusting means 902 is implemented as a hook-and-loop fastener, is illustrated in FIG. 9C. The clamping arrangement 106 may comprise buckle, ring, such as D-ring, square ring loop, or similar 902C, around which the strap 108 may be flipped over, i.e. turned. Furthermore, one of the hook fastener or loop fastener 902A may be arranged to a first section of the strap 108A and the other one of the hook fastener or the loop fastener 602B may be arranged to a second section of the strap 108B. The first section of the strap 108A may be arranged against the helmet shell 102 so that the one of the hook fastener or loop fastener 902A is facing outwards from the helmet shell 102. Moreover, the second section of the strap 108B is arranged to the section of the strap that is turned around the buckle, ring, or other similar 902C so that the other one of the hook fastener or the loop fastener 902B may be arranged to face towards the helmet shell 102 and the first section of the strap 108A (the hook/loop fastener 902B is not shown in FIG. 9C, because it is facing towards the helmet shell 102). The first section and the second section of the strap 108A, 108B may be attached to each other so that the one of the hook fastener or the loop fastener 902A and the other one of the hook fastener or the loop fastener 902B are facing towards each other and may be attached at least partly to each other in order to adjust the length of the coupling means 108, i.e. strap so that the mounting system fits to the helmet shell 102 in question.

Figure 9D:
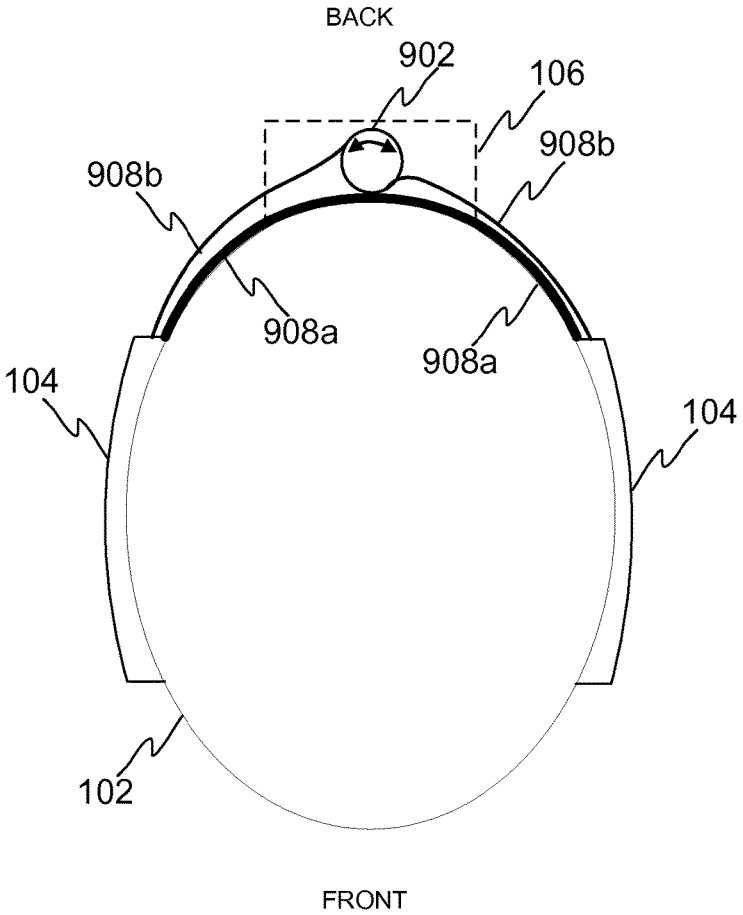
FIG. 9D illustrates schematically another example of adjusting means of the mounting system according to the invention.
Figure 9E:
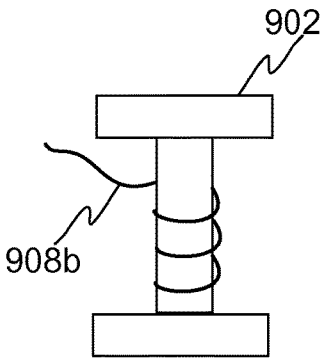
FIG. 9E illustrates schematically another example of adjusting means of the mounting system according to the invention.

In the above presented examples illustrated in FIGS. 9B and 9C the coupling means 108 are implemented as a common coupling means for providing mechanical and electrical coupling, for example electrical wirings integrated to the strap, together with a common adjusting means 902. Alternatively, the coupling means 108 may be implemented as separate mechanical part of coupling means 908*a* for proving mechanical coupling, such as a strap, and separate electrical part of the coupling means 908*b* for providing electrical coupling, such as electrical wirings. The mounting system may further comprise separate adjusting means 902*b* for adjusting the length of the electrical wirings, for example an adjusting knob, adjusting wheel, or wheeling mechanism. This is illustrated in FIG. 9D, wherein an example mounting system comprises a wheeling mechanism as a separated adjusting means 902 for adjusting the length of the electrical part of the coupling means 908*b* in addition to the one of the above described hook-and-loop fastener (for sake of clarity not shown in FIG. 9D) for adjusting the length of the mechanical part of the coupling means 908*a*. The excess of the electrical part of the coupling means 908*b*, such as a wire, may be arranged to be coiled around the wheeling mechanism 902 in order to adjust the length of the electrical coupling means, as illustrated in FIG. 9E, wherein an example of the wheeling mechanism 902 is illustrated from another view. By turning the wheeling mechanism 902 in a first direction the length of the electrical part of the coupling means 908*b* is shorten and by turning the wheeling mechanism 902 in a second direction the length of the electrical part of the coupling means 908*b* is lengthen, wherein the first direction may be clockwise and the second direction may be counter clockwise or in vice versa.

Figure 10A:
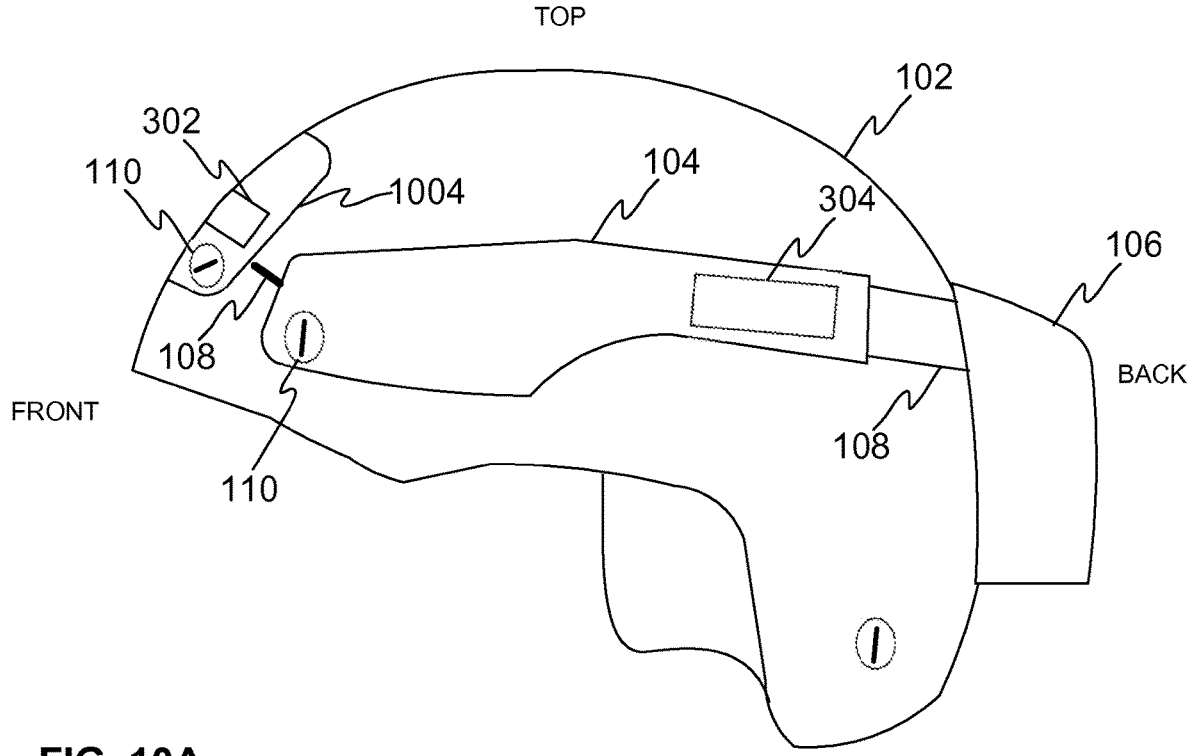
FIG. 10A illustrates schematically another example of the mounting system according to the invention attached to a helmet.
Figure 10B:
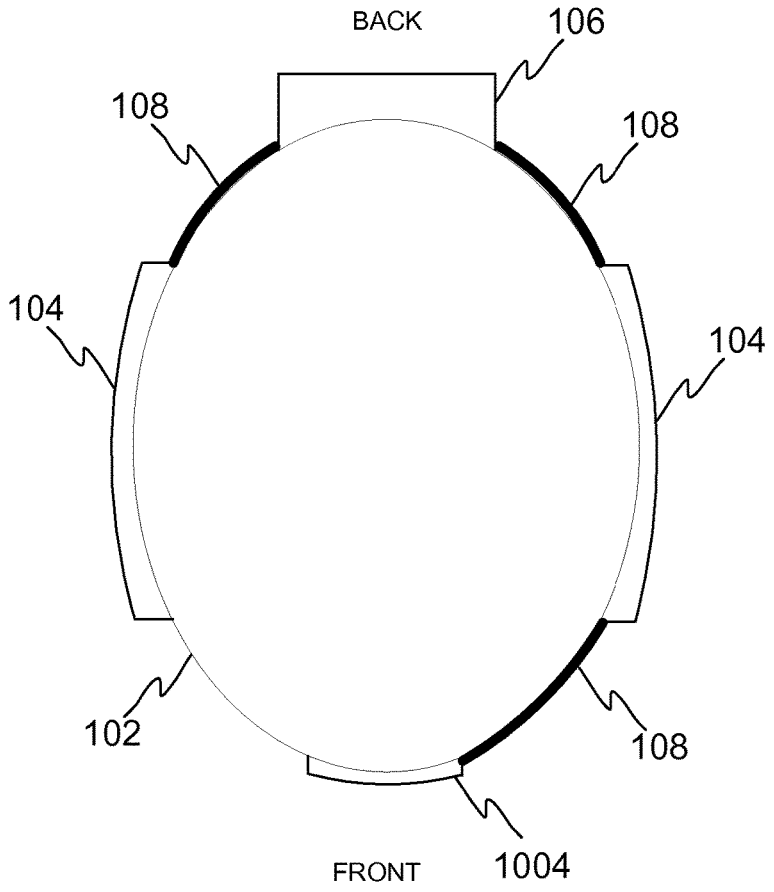
FIG. 10B illustrates schematically another example of the mounting system according to the invention attached to a helmet from another view.

The hereinbefore described mounting system may further comprise one or more additional mounting rails 1004 arranged on exterior of the helmet shell 102. The one or more additional mounting rails 1004 may be arranged substantially in the front portion of the helmet shell 102 or in the top portion of the helmet shell 102. The one or more additional mounting rails 1004 may comprise fixing means 110 for anchoring the third mounting rail to a respective fixing point of the helmet shell 102 similarly as described above for the pair mounting rails 104. The one or more additional mounting rails 1004 may be coupled to at least one of the mounting rails 104 via coupling means 108 having an adjustable length similarly as described above for coupling the at least one mounting rails 104 to the clamping means 106. The coupling means 108 may provide mechanical coupling and/or electrical coupling between the one or more additional mounting rails 1004 and the at least one of the mounting rails 104. FIG. 10A illustrates one example of the clamping system according to the invention, wherein the mounting system comprises also one additional mounting rail 1004 arranged substantially in the front portion of the helmet shell 102. FIG. 10B, in turn, schematically illustrates one example of the mounting system according to the invention viewed from the above, i.e. providing a view towards the top portion of the exterior of the helmet 102, wherein the mounting system comprises also one additional mounting rail 1004 arranged substantially in the front portion of the helmet shell 102.

According to one embodiment of the invention one or more accessory devices may be mechanically attached to one of the mounting rails 104 of the mounting system and any data transfer between the accessory device mounted to the one of the mounting rails 104 and a control unit implemented as a part of the clamping arrangement 106 or as an external unit may be based on any known wireless communication technology.

According to one embodiment of the invention at least one of the mounting rails 104 of the mounting system may be attached to a helmet by using an existing mechanical mounting interface of the helmet. The existing mechanical mounting interface of a helmet may be at least one of the following: side rail, shroud.

According to one embodiment of the invention the mounting system may further comprise one or more adapter parts that may be arranged between one or more parts of the mounting system and the helmet shell in order to align the one or more parts of the mounting system to a desired orientation. For example one or more adapter parts may be arranged between one of the mounting rails and the helmet shell in order to align said mounting rail to a desired orientation and at least partly eliminate gaps and/or play between them.

The mounting system described above is suitable for almost any helmet regardless of the properties of the helmet, such as size, shape, type, shell thickness, brand, for example. Furthermore, the mounting system enables a stable, i.e. solid attachment of the mounting system to a helmet. Moreover, the mounting system may enable adding power and/or data capability to any helmet by means of the mounting system. The adjustability of the mounting system allows that one size fits all. Moreover, the mounting system according to the invention is retrofittable to almost any helmet because of the combination of substantially rigid, i.e. solid, parts interconnected in a way that the relative position of the said parts may be adjusted by means of the adjustable coupling means. Additionally, the mounting system according to the invention enables upgrade of any existing helmet instead of a procurement of a complete system comprising the helmet. Furthermore, the mounting system according to the invention is retrofittable without any major modifications to the helmet.

Furthermore, the mounting system may be attached to a helmet easily by a user even without any disassembly of the helmet, because of the simple attachment of the mounting rails and the clamping arrangement. If the helmet comprises some existing mounting hardware for attachment of the mounting system, disassembly/assembly of the existing mounting hardware, such as a screw, bolt, or similar, may be needed. Moreover, the mounting system may be attached to a helmet in a way that it is as close to the helmet as possible as described earlier. This enables that a formation of one or more significant gaps between the mounting system and the helmet shell are at least partly prevented. One or more gaps between the mounting system and the helmet shell would make the whole system weaker and the mounting of the one or more accessory device less stable, and may introduce snagging hazard, such as the user's head may get stuck e.g. in the foliage.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A mounting system for mounting one or more accessory devices to a helmet shell of a helmet, the helmet shell having an exterior with a front portion, a back portion, and two opposite sides that extend between the front portion and the rear portion, the mounting system comprising:

a pair of mounting rails, each of the mounting rails configured to be attached on a respective one of the two opposite sides that extends between the front and back portions of the exterior of the helmet shell so that front-most parts of the mounting rails are spaced apart from each other, wherein each of the mounting rails includes one or more accessory connection ports, the one or more accessory connection ports being configured to provide electrical connection to one or more accessory devices attached thereto;

a coupling part having an adjustable length, the coupling part comprises a mechanical part and an electrical part; and a clamping arrangement, the clamping arrangement configured to be attached on the exterior of the helmet shell between the pair of mounting rails and substantially in the back portion of the helmet shell, wherein the clamping arrangement comprises a control interface, wherein the clamping arrangement is coupled to at least one of the mounting rails via the coupling part, the adjustable length of the coupling part is configured to provide attachment of the mounting system to helmet shells having various properties, wherein the coupling part is configured to provide electrical connection between the control interface of the clamping arrangement and the one or more accessory connection ports of the at least one of the mounting rails to provide the electrical connection to the one or more accessory devices attached thereto.

2. The mounting system according to claim 1, wherein at least one of the mounting rails comprises one or more accessory rails and/or one or more mounting spots for detachably mounting an accessory device thereto.

3. The mounting system according to claim 2, wherein the clamping arrangement has a concave surface configured for facing a convex surface on the exterior of the helmet shell for secure attachment thereto.

4. The mounting system according to claim 1, wherein the clamping arrangement has a concave surface configured for facing a convex surface on the exterior of the helmet shell for secure attachment thereto.

5. The mounting system according to claim 1, wherein the clamping arrangement further comprises mounting hardware configured for anchoring the clamping arrangement to a respective fixing point of the helmet shell for improved mechanical strength and stability of the attachment of the clamping arrangement to the helmet shell.

6. The mounting system according to claim 1, wherein each of the mounting rails comprises mounting hardware configured for anchoring said mounting rail to a respective fixing point of the helmet shell for improved mechanical strength and stability of the attachment of the mounting rails arrangement to the helmet shell.

7. The mounting system according to claim 1 in combination with the helmet, wherein an existing mounting hardware of the helmet attaches the clamping arrangement to an existing mounting point of the helmet.

8. The mounting system according to claim 1, wherein the clamping arrangement comprises a hook-shaped component configured to extend around a trim of the helmet shell.

9. The mounting system according to claim 1, wherein the control interface of the clamping arrangement is configured to at least provide an electrical connection to one or more external units, wherein the one or more external units comprise a control unit, a control device, a computing unit, and/or a communication device.

10. The mounting system according to claim 1, wherein the clamping arrangement further comprises one or more further connection accessory connection ports configured to provide an electrical connection to the one or more accessory devices attached thereto.

11. The mounting system according to claim 1, wherein the mounting system further comprises adjusting means for adjusting the length of the coupling part, wherein the adjusting means is at least one of the following: adjustment knob, adjustment wheel, wheeling mechanism, one or more hook-and-loop fastener.

12. The mounting system according to claim 1, wherein the mounting system further comprises one or more additional mounting rails configured to be arranged on the exterior of the helmet shell, wherein the one or more additional mounting rails is coupled to at least one of the mounting rails via a coupling part having an adjustable length for enabling attachment to helmet shells having various properties.

13. The mounting system according to claim 1 in combination with the helmet, wherein an existing mounting hardware of the helmet is configured to attach the pair of mounting rails to an existing mounting point of the helmet.

14. The mounting system of claim 1 in combination with the helmet, wherein, each of the mounting rails is attached on one of the respective opposite sides of the exterior of the helmet shell, the clamping arrangement is attached on the exterior of the helmet shell between the pair of mounting rails substantially in the back portion of the helmet shell, and the coupling part provides the electrical connection between the clamping arrangement and the one or more accessory connection ports of the at least one of the mounting rails.

* * * * *